US007968824B2

(12) United States Patent
Lee et al.

(10) Patent No.: US 7,968,824 B2
(45) Date of Patent: Jun. 28, 2011

(54) METHOD FOR CONTROLLING HEATING COOKING APPARATUS

(75) Inventors: Young Jun Lee, Seoul (KR); Seung Jo Baek, Gwangmyeong-si (KR); Byeong Wook Park, Gwangmyeong-si (KR); Hee Suk Roh, Incheon (KR)

(73) Assignee: LG Electronics Inc., Seoul (KR)

( * ) Notice: Subject to any disclaimer, the term of this patent is extended or adjusted under 35 U.S.C. 154(b) by 447 days.

(21) Appl. No.: 11/902,198

(22) Filed: Sep. 19, 2007

(65) Prior Publication Data

US 2008/0237215 A1 Oct. 2, 2008

(30) Foreign Application Priority Data

Mar. 28, 2007 (KR) ..... 10-2007-0030174

(51) Int. Cl.
*H05B 3/68* (2006.01)
*H05B 1/02* (2006.01)

(52) U.S. Cl. ..... 219/447.1; 219/518

(58) Field of Classification Search .... 219/443.1–468.2, 219/518

See application file for complete search history.

(56) References Cited

U.S. PATENT DOCUMENTS

| | | | | |
|---|---|---|---|---|
| 4,135,081 | A | 1/1979 | Fischer | |
| 4,493,981 | A * | 1/1985 | Payne | 219/448.12 |
| 4,740,664 | A | 4/1988 | Payne et al. | |
| 6,246,033 | B1 * | 6/2001 | Shah | 219/447.1 |
| 6,903,311 | B2 | 6/2005 | Tembe | |
| 2005/0184044 | A1 | 8/2005 | Reiter et al. | |
| 2006/0118544 | A1 | 6/2006 | Wilkins | |

FOREIGN PATENT DOCUMENTS

| | | |
|---|---|---|
| CN | 1364990 | 8/2002 |
| CN | 2823852 | 10/2006 |
| DE | 4104677 | 8/1982 |
| DE | 4104677 A1 | 8/1992 |
| DE | 198 46 236 | 5/1999 |
| DE | 10 2004 05915 | 6/2006 |
| DE | 10 2004 05982 | 6/2006 |
| EP | 1217874 | 12/2001 |
| GB | 2247578 A | 3/1992 |
| WO | WO 2005/07667 | 8/2005 |

* cited by examiner

*Primary Examiner* — Sang Y Paik
(74) *Attorney, Agent, or Firm* — McKenna Long & Aldridge LLP

(57) ABSTRACT

A method for controlling a heating cooking apparatus, in which an operation of a heating unit is appropriately controlled according to presence/absence or kinds of a load applied to a plate. When no load is applied to the plate, the duty cycle of a heat source is reduced, thereby preventing unnecessary operation of the heat source. Accordingly, power consumption is reduced. On the other hand, when a load is applied to the plate, the duty cycle of the heat source is increased. Speedy cooking may be possible with this control method.

7 Claims, 13 Drawing Sheets

METHOD FOR CONTROLLING HEATING COOKING APPARATUS

This application claims the benefit of Korean Patent Application No. 10-2007-0030174 filed on Mar. 28, 2007, which is hereby incorporated by reference for all purposes as if fully set forth herein.

BACKGROUND

Embodiments relate to methods for controlling an operation of a heat source.

Heating cooking apparatuses are appliances that heat and cook food. In particular, a cook top is an appliance that generates heat and cooks food by heating a cooking container placed on a plate. The cook top is also called a hot plate or a hob. The use of the cook top has been increasing in recent years.

A related art cook top includes a plurality of heating units under a plate. A thermostat is provided at the heating units to prevent the plate from overheating.

The thermostat detects heat generated from the heating units and switches at a predetermined temperature to turn on/off the heating units. In this way, the thermostat regulates a temperature of the plate.

In such a cook top, however, the thermostat is configured to strictly operate at a predetermined temperature. Therefore, the temperature of the plate does not change according to a load applied to the plate, that is, by presence or absence, or kinds of the heating container.

In other words, the heat source is configured to operate at a predetermined duty, regardless of the presence or absence, or kinds of the load. The duty is defined by a unit on-time ratio of the heat source and expressed as $T_{on}/(T_{on}+T_{off})$, where $T_{on}$ and $T_{off}$ represent an on time and an off time of the heat source, respectively.

In addition, because the thermostat operates mechanically, it is not sensitive to the heating environment of the plate.

SUMMARY

Embodiments provide methods for controlling a heating cooking apparatus, in which an operation of a heating unit can be appropriately controlled according to presence or absence, or kinds of load applied to a plate.

Embodiments also provide methods for controlling a heating cooking apparatus, which can prevent unnecessary power consumption of a heating unit and make a speedy cooking possible.

In one embodiment, a method for operating a heating cooking apparatus includes sensing at least one variable using a sensor that is indicative of whether at least one of a load, an absence of load, and a kind of load is present on a plate of the heating cooking apparatus, and controlling a duty cycle of power supplied to a heating source based on the variable sensed by the sensor.

In another embodiment, a method for operating a heat cooking apparatus includes sensing a heat transfer of a plate or a plate surrounding over time using a sensor when power is supplied to a heating source, applying a first time interval as power-on portion of a duty cycle when the heat transfer over time is indicative that the plate has no load, and applying a second time interval as the power-on portion of the duty cycle when the heat transfer rate over time is indicative that the plate has a load, wherein the second time interval is longer than the first time interval.

In further another embodiment, a method for operating a heating cooking apparatus includes causing a controller to determine a temperature change rate of a plate or a temperature change rate corresponding to the plate based on information received from a sensor when power is supplied to a heating source, where a determined first temperature change rate is indicative of the plate without a load and a determined second temperature change rate is indicative of the plate with a load, and the first temperature change rate being greater than the second temperature change rate, causing the controller to apply a first duration as a power-on portion of a duty cycle when the controller determines that the temperature change rate corresponds to the first temperature change rate, and causing the controller to apply a second duration as the power-on portion of the duty cycle when the controller determines that the temperature change rate corresponds to the second temperature change rate, where the first duration is shorter than the second duration.

The details of one or more embodiments are set forth in the accompanying drawings and the description below. Other features will be apparent from the description and drawings, and from the claims.

BRIEF DESCRIPTION OF THE DRAWINGS

Embodiments can be understood more fully from the following detailed description in conjunction with the accompanying drawings.

DETAILED DESCRIPTION OF THE EMBODIMENTS

Embodiments of a temperature detecting device and a heating cooking apparatus using the same will be described below in detail with reference to the accompanying drawings.

Figure 1:
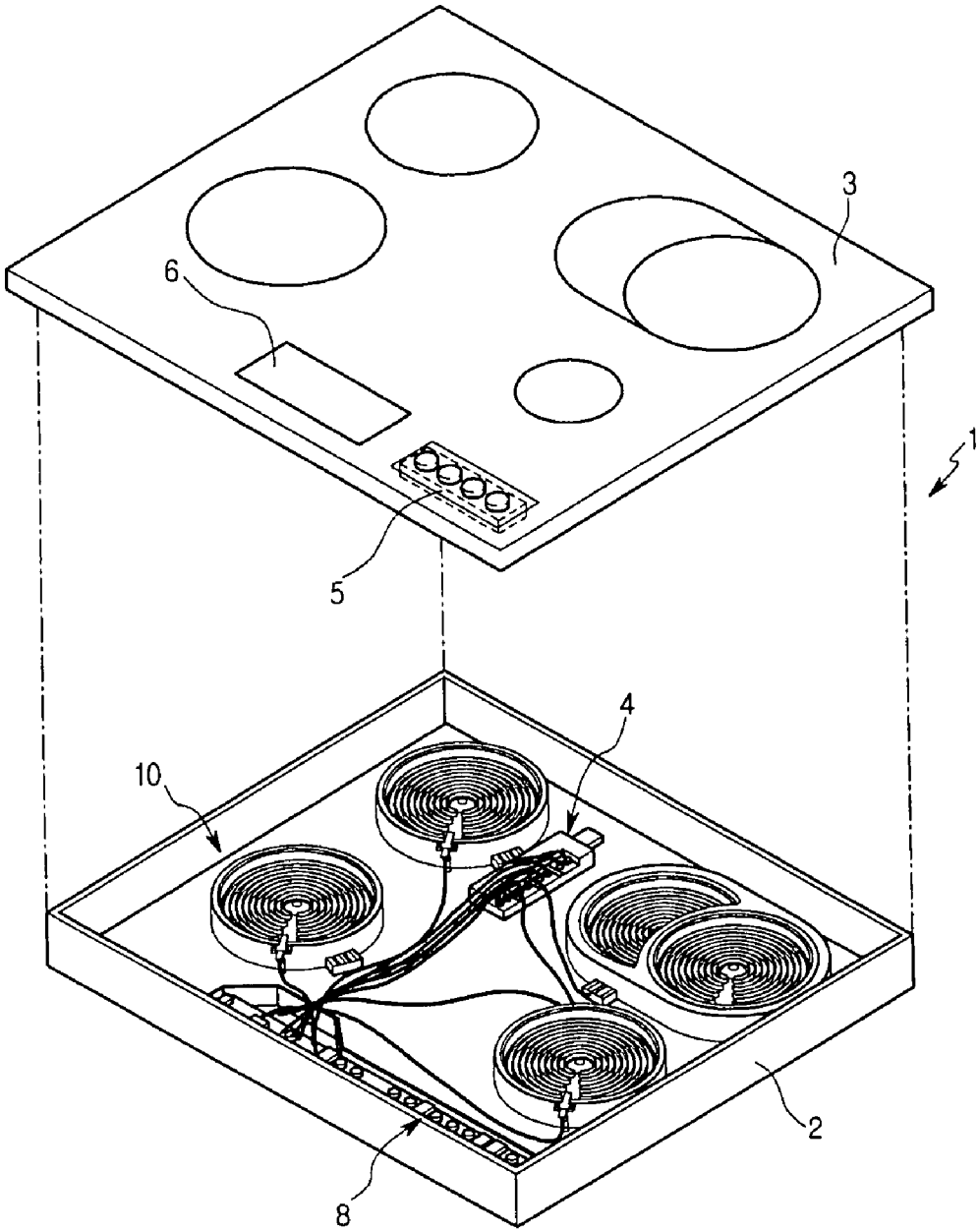
FIG. 1 is an exploded perspective view illustrating an embodiment of a heating cooking apparatus with a ceramic plate.
Figure 2:
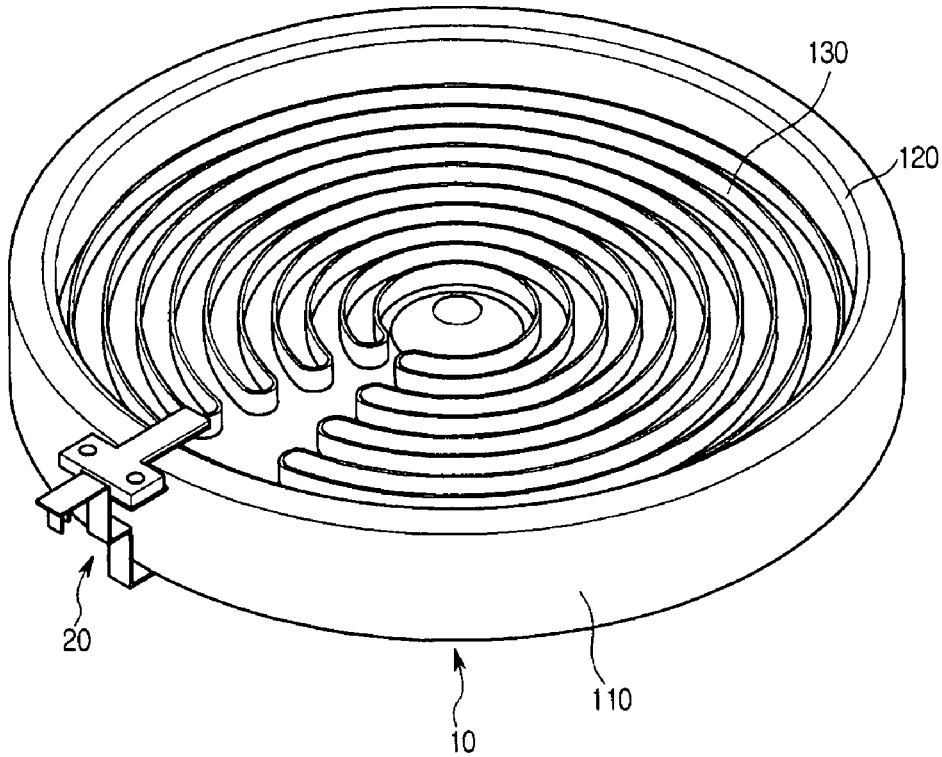
FIG. 2 is an assembled perspective view of a heating unit and a temperature detecting device according to one embodiment.

FIG. 1 is an exploded perspective view illustrating an embodiment of a heating cooking apparatus with a ceramic plate; FIG. 2 is an assembled perspective view of a heating unit and a temperature detecting device; and FIG. 3 is a partial sectional view of the heating cooking apparatus shown in FIG. 1.

Figure 3:
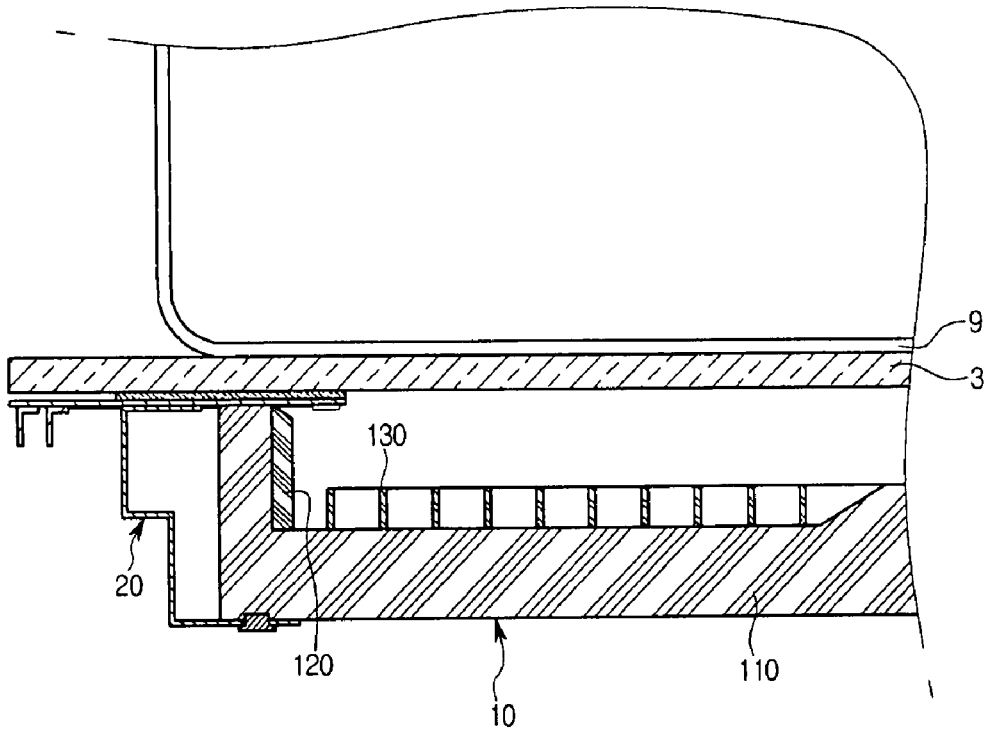
FIG. 3 is a partial sectional view of the heating cooking apparatus shown in FIG. 1.

Referring to FIGS. 1 to 3, the heating cooking apparatus 1 includes a main body 2 and a plate 3, which may be ceramic. While other materials may be used for a plate such as glass, stone, metal, etc., for purposes of illustration a plate 3 made of ceramic will be used. The main body 2 receives at least one heating unit 10, and the ceramic plate 3 is provided above the main body 2.

The main body 2 defines an outer appearance of the heating cooking apparatus 1. A power supply 4, a control unit 8, and at least one heating unit 10 are provided inside the main body 2.

The heating unit 10 includes a casing 110, an insulator 120 provided inside the casing 110, and a heat source 130 provided inside the casing 110.

The heat source 130 may be a coil-shaped electrical resistance heating element, but there is no limitation in types of the heat source 130. In other words, various types of the heat source 130, e.g., an electrical induction heating element, may be used herein.

A temperature detecting device 20 is coupled to the heating unit 10 to detect a temperature of at least the heat source 130.

The temperature detecting device 20 detects a temperature of heat from at least the heat source 130, and sends information on the detected temperature to the control unit 8. The control unit 8 controls the operation of the heating unit 10 according to the received information on the detected temperature.

A cooking container 9 may be placed on the ceramic plate 3. A control panel 5 and a display unit 6 are provided on a frontal top surface of the ceramic plate 3. The control panel 5 controls a cooking operation of the heating cooking apparatus 1, and the display unit 6 displays an operating state of the heating cooking apparatus 1.

The operation of the heating cooling apparatus 1 will be briefly described below.

When cooking food at the heating cooking apparatus 1, the cooking container 9 containing the food is placed on the ceramic plate 3 and the operation of the heating cooking apparatus 1 is started.

When the heating cooking apparatus 1 is turned on, the heating unit 10 operates. Some of the heat generated from the heating unit 10 is directly transferred to the cooking container 9, and some is transferred through the ceramic plate 3 to the cooking container 9. The food is cooked by the heat transferred in this manner.

During cooking, the temperature detecting device 20 detects and sends information regarding temperature of at least the heat source 130, and the heat source 130 is appropriately operated by the control unit 8 according to the received information on the detected temperature.

The control unit 8 may include a microprocessor for performing a control operation based on the temperature detected by the temperature detecting device 20, and a memory containing instructions, which when executed by the microprocessor causes the microprocessor to perform the control operation.

A structure of the temperature detecting device 20 will be described below in detail.

Figure 4:
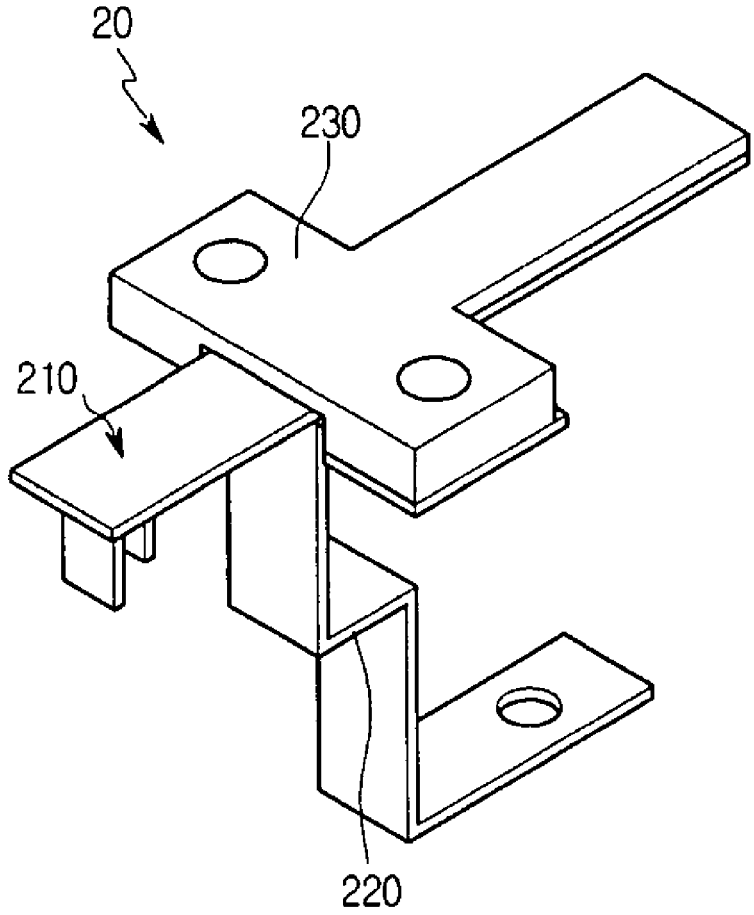
FIG. 4 is a perspective view of the temperature detecting device shown in FIG. 2.
Figure 5:
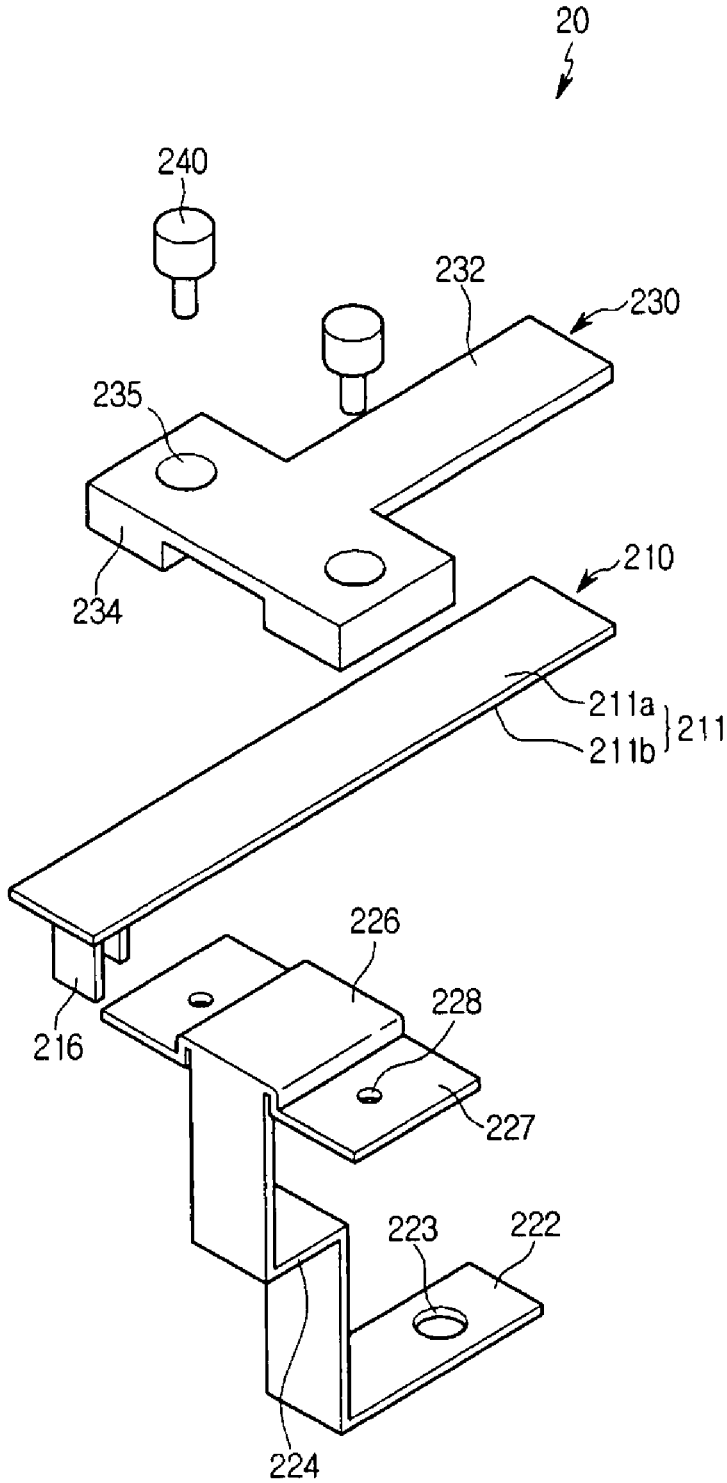
FIG. 5 is an exploded perspective view of the temperature detecting device shown in FIG. 4.

FIG. 4 is a perspective view of the temperature detecting device shown in FIG. 2; FIG. 5 is an exploded perspective view of the temperature detecting device shown in FIG. 4; and FIG. 6 is a bottom view of a detecting member shown in FIG. 4.

Figure 6:
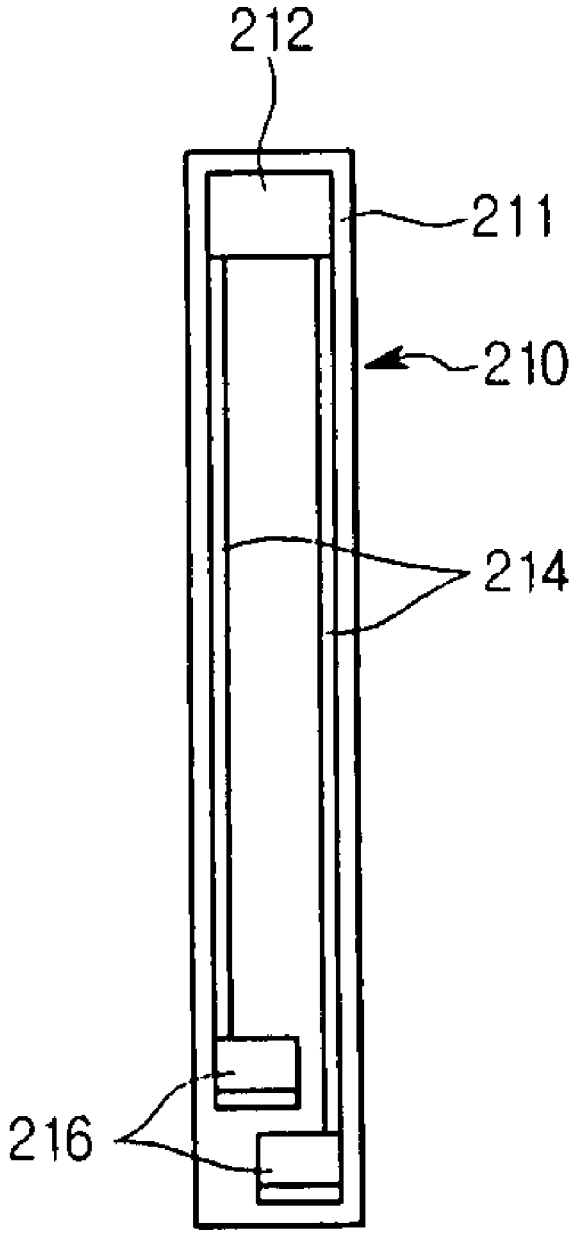
FIG. 6 is a bottom view illustrating an embodiment of a detecting member shown in FIG. 4.

Referring to FIGS. 4 to 6, the temperature detecting device 20 is provided in each heating unit 10 and may be coupled to one side of the heating unit 10.

The temperature detecting device 20 includes a detecting member 210, a supporting member 220, and a transferring member 230. The detecting member 210 electrically detects a temperature of heat. The supporting member 220 supports the detecting member 210 and connects the temperature detecting device 20 to the heating unit 10. The transferring member 230 is disposed on the detecting member 210 to transfer heat of the ceramic plate 220 to the detecting member 210.

The detecting member 210 includes a substrate 211 made of ceramic or other insulating materials. The substrate 211 has a top surface 211*a* and a bottom surface 211*b*. A temperature sensor 212 may be provided at one end of the bottom surface 211*b* of the substrate 211.

The temperature sensor 212 may be printed on the bottom surface 211*b* of the substrate 211. Examples of the temperature sensor 212 include a negative temperature coefficient (NTC) type sensor and a positive temperature coefficient (PTC) type sensor. The NTC type sensor has a resistance that decreases with increasing temperature, and the PTC type sensor has a resistance that increases with increasing temperature.

The temperature sensor 212 senses a temperature change in a form of a resistance change. The control unit 8 determines temperature by amplifying the resistance change using an amplifier circuit.

When the temperature detecting device 20 is coupled to the heating unit 10, a portion of the detecting member 210 where the temperature sensor 212 is disposed is exposed to an inner space of the heating unit 10. The temperature sensor 212 is in the vicinity of the heat source 130, and in one embodiment is opposite to the heat source 130. In another embodiment, the temperature sensor 212 is arranged to face the heat source 130.

In this configuration, when the heat source 130 operates, heat generated from the heat source 130 is directly radiated to the temperature sensor 212. In other words, the temperature sensor 212 directly detects the temperature of the heat radiated from the heat source 130.

Therefore, the temperature sensor 212 sensitively detects the temperature of the heat source 130, and the control unit 8 can more accurately control the operation of the heat source 130.

A pair of terminals 216 may be provided at the bottom surface 211*b* of the substrate 211. The terminals 216 electrically couple to the control unit 8.

The terminals 216 and the temperature sensor 212 are electrically connected by a pair of conductors 214. In this embodiment, the terminals 216, the conductors 214, and the temperature sensor 212 are provided at the bottom surface 211*b* of the detecting member 210.

The conductors 214 may be made of a material equal or similar to that of the temperature sensor 212.

The supporting member 220 connects the temperature detecting device 20 to the heating unit 10 and supports the detecting member 210 at a predetermined height. The supporting member 220 may be made of an elastic material that may be metallic.

The supporting member 220 includes a bottom portion 222, a middle portion 224 extending upward from one end of the bottom portion 222 at a predetermined height, and a top portion 226 extending from the middle portion 224 in the same direction as the bottom portion 222.

The bottom portion 222 of the supporting member 220 is connected to a bottom surface of the heating unit 10. In addition, at least one connecting hole 223 through which a connecting member (not shown) passes is formed in the bottom portion of the 222.

The middle portion 224 of the supporting member 220 is bent in multiple places and has a height substantially equal to the heat unit 10.

The top portion 226 of the supporting member 220 has a width substantially equal to that of the detecting member 210, so that at least a portion of the detecting member 210 is mounted on the top portion 226 of the supporting member 220.

Coupling tabs 227 are provided at both sides of the top portion 226 of the supporting member 220 to connect the transferring member 230 to the supporting member 220. In other words, the coupling tabs 227 extend downward from both sides of the top portion 226 by a predetermined length and then extend in a horizontal direction by a predetermined length. Thus, a height difference occurs between the top portion 226 and the coupling tabs 227.

The top surface of the transferring member 230 is in contact with the bottom surface of the ceramic plate 3. The transferring member 230 is disposed on the detecting member 210 to transfer heat of the ceramic plate 3 to the detecting member 210.

Hence, the detecting member 210 directly detects the temperature of the heat generated from the heat source 130, and indirectly detects the temperature of the heat of the ceramic plate 3 through the transferring member 230.

The transferring member 230 may be formed of a material having high heat conductivity, e.g., aluminum.

The heat of the ceramic plate 3, which is transferred from the detecting member 210 through the transferring member 230, changes depending on the load applied to the ceramic plate 3. Therefore, the temperature detected by the temperature sensor 212 changes.

Because the temperature that is detected by the temperature sensor 212 is changed by the heat transferred from the ceramic plate 3, the operation of the heating unit 110 can be appropriately controlled according to the presence or absence of the load applied to the ceramic plate 3. Its detailed description will be made later.

The load will be described below in detail.

In this disclosure, when the cooking container 9 is not placed on the ceramic plate 3, it means that no load is being applied to the ceramic plate 3. When the cooking container 9 is placed on the ceramic plate 3, it means that that the load is being applied to the ceramic plate 3. A change of the load means that the load is changed depending on types or kinds of the cooking container 9 or food.

The transferring member 230 has a width substantially equal to that of the detecting member 210 and includes a cover 232 and a coupling portion. The cover 232 covers a portion of the top surface of the detecting member 210, and the coupling portion 234 connects the transferring member 230 to the supporting member 220.

A thickness of the coupling portion 234 is greater than that of the cover 230. Therefore, when the transferring member 230 is connected to the coupling tabs 227, the coupling portion 234 surrounds the detecting member 210 and the top portion 226 of the supporting member 220.

In this case, the detecting member 210 cannot move forward or backward and left or right as it is fixed to and supported by the supporting member 220.

The coupling tabs 227 have coupling holes 228 and the coupling portion 234 has coupling holes 235. Coupling members 240 are inserted into the coupling holes 228 and 235 to fix the transferring member 230 to the supporting member 220.

An operation relationship between the temperature detecting device 20 and the heat source 130 will now be described below.

When the heat source 130 operates, the temperature sensor 212 of the temperature detecting device 20 senses a temperature of the heat source 130 and outputs a resistance value based on sensed temperature, and the control unit 8 determines a temperature value by amplifying a change of the resistance value using an amplifier circuit.

The control unit 8 turns off the heat source 130 when the detected temperature reaches a first reference temperature. In this case, the temperature detected by the temperature detecting device 20 decreases. During the decrease of the temperature, the heat source 130 is again turned on when the temperature detected by the temperature detecting device 20 reaches a second reference temperature lower than the first reference temperature.

Thus, the heat source 130 is continuously turned on/off according to the detected temperature.

In this embodiment, the operation of the heat source 130 is controlled such that the temperature detected by the temperature detecting device 20 is maintained in a range between the first and second reference temperatures.

At this point, a duty cycle has a large value when the on time of the heat source 130 is long, but it has a small value when the on time of the heat source 130 is short.

An operation of the heat source 130 according to the presence or absence of the load applied to the ceramic plate 3 will be described below.

Figure 7:
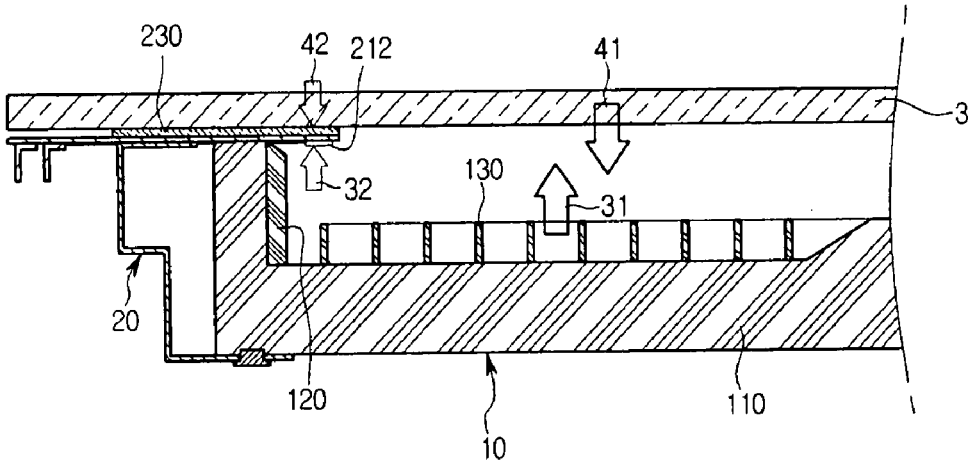
FIG. 7 is a partial sectional view illustrating heat transfers that occur when a cooking container is not placed on the heating cooking apparatus.
Figure 8:
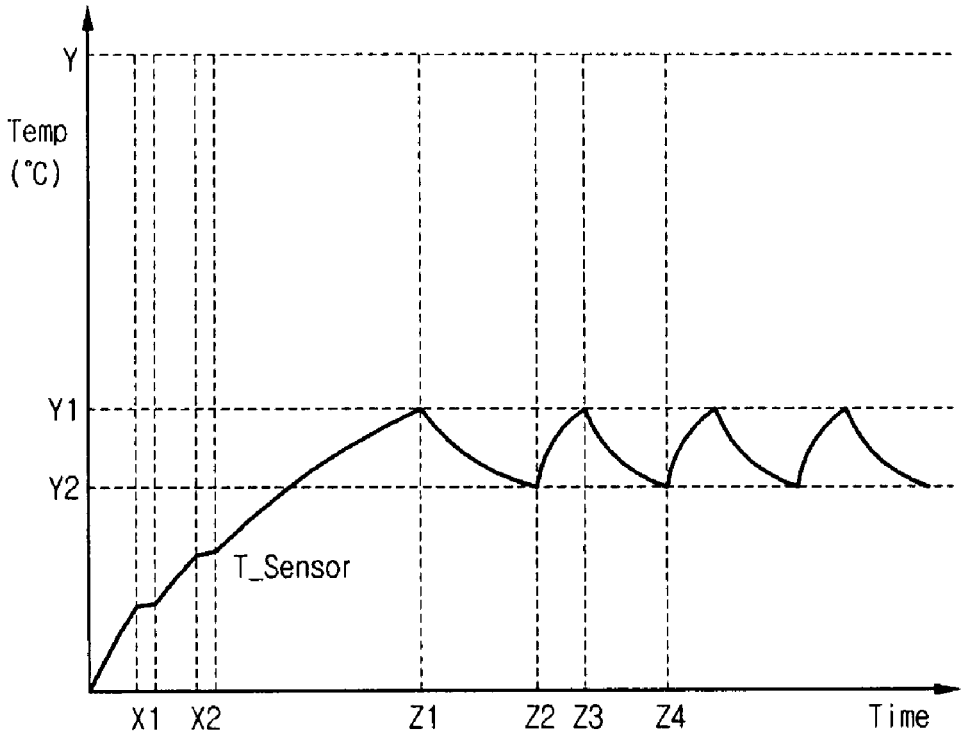
FIG. 8 is a graph illustrating a change of a temperature detected by a detecting member when the cooking container is not placed on the heating cooking apparatus.
Figure 9:
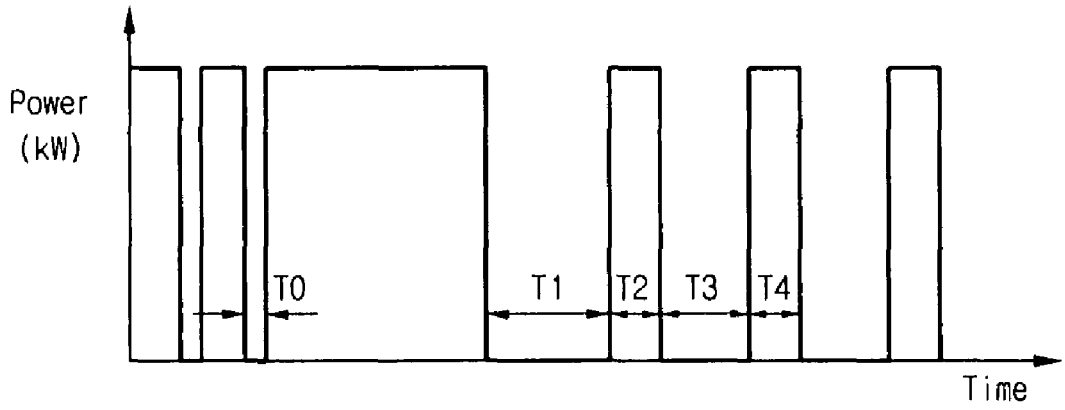
FIG. 9 is a graph illustrating the on/off operations of a heat source when the cooking container is not placed on the heating cooking apparatus.

FIG. 7 is a partial sectional view illustrating heat transfers when the cooking container is not placed on the heating cooking apparatus; FIG. 8 is a graph illustrating a change of a temperature detected by the detecting member when the cooking container is not placed on the heating cooking apparatus; and FIG. 9 is a graph illustrating the on/off operations of the heat source when the cooking container is not placed on the heating cooking apparatus.

In FIG. 7, heat transferred from the heat source 130 and heat transferred from the ceramic plate 3 to another region are indicated by arrows, and a large arrow indicates a large amount of heat in comparison with a small arrow.

In FIG. 8, a horizontal axis and a vertical axis represent time and temperature, respectively. In FIG. 9, a horizontal axis and a vertical axis represent time and power, respectively.

In the following description, a detected temperature represents a temperature detected by the temperature sensor 212.

The case where no load is applied to the ceramic plate 3 will be described below with reference to FIGS. 7 to 9.

When the heat source 130 operates where the cooking container 9 is not placed on the ceramic plate 3, some heat 31 generated from the heat source 130 is directly transferred to the ceramic plate 3 and some heat 32 is directly transferred to the temperature sensor 212.

Some heat 41 transferred to the ceramic plate 3 is transferred to the heating unit or the heat source, and some heat 42 is transferred to the temperature sensor 212. The heat 42 transferred to the ceramic plate 3 is transferred to the temperature sensor 212 through the transferring member 230.

That is, when the cooking container 9 is not placed on the ceramic plate 3, the ceramic plate 3 retains the heat 31 transferred from the heat source 130 and transfers the heat 41 and the heat 42 to the heating unit 10 and the transferring member 230, respectively.

In other words, most of the heat transferred to the ceramic plate 3 is transferred to the temperature sensor 212 and the heating unit 10. Hence, as shown in FIG. 8, the temperature detected by the temperature detecting device 20 when the heat source 130 is turned on rapidly increases to reach the first reference temperature Y1.

The first reference temperature Y1 detected by the temperature sensor 212 is a temperature before the temperature of the ceramic plate 3 reaches a critical temperature Y. It can be easily understood that the first reference temperature Y1 is less than the critical temperature Y.

In order to increase heat efficiency until the temperature detected in the on state of the heat source 130 initially reaches the first reference temperature Y1, the heat source 130 may be turned on/off at least one time during a predetermined time interval T0.

In other words, the heat efficiency can be increased using latent heat of the ceramic plate 3 such that the heat source 130 is in an off state for a predetermined time. In this case, the heat source 130 may be turned off after a predetermined time X1 and X2 elapses from the operation of the heat source 130, or may be turned off when the detected temperature reaches a predetermined temperature lower than the second reference temperature Y2.

When the detected temperature reaches the first reference temperature Y1, the heat source 130 is turned off. When the heat source 130 is turned off, the detected temperature slowly decreases as shown in FIG. 8. The reason why the temperature detected by the temperature sensor 212 slowly decreases is because the temperature sensor 212 is continuously supplied with the heat from the ceramic plate 3.

When the detected temperature decreases to the second reference temperature Y2, the heat source 130 is again turned on. The detected temperature then rapidly increases up to the first reference temperature Y1.

In other words, the heat source 130 is continuously turned on/off such that the temperature detected by the temperature sensor 212 is maintained in a range between the first reference temperature Y1 and the second reference temperature Y2.

When the detected temperature rapidly increases, time T2 and T4 taken for the detected temperature to reach the first reference temperature Y1 becomes short. This means that the on time of the heat source 130 becomes short. That is, the temperature increase rate per unit time is high.

On the other hand, when the detected temperature slowly decreases, time T1 and T3 taken for the detected temperature to reach the second reference temperature Y2 becomes long. This means that the off time of the heat source 130 becomes long. That is, the temperature decrease rate per unit time is low.

The duty cycle (i.e., the unit on-time ratio) of the heat source 130 is reduced because the on time of the heat source 130 is short and its off time is long.

The reduced duty cycle minimizes the operation time of the heat source 130 when the cooking container 9 is not placed on the ceramic plate 3, thereby reducing unnecessary power consumption.

Thus, in this embodiment, the heat source 130 is controlled such that its duty cycle is reduced when the cooking container 9 is not placed on the ceramic plate 3.

It is apparent that the operation of the heat source 130 can be maintained at a reduced duty cycle even when the heat source 130 is operated with the same power.

Figure 10:
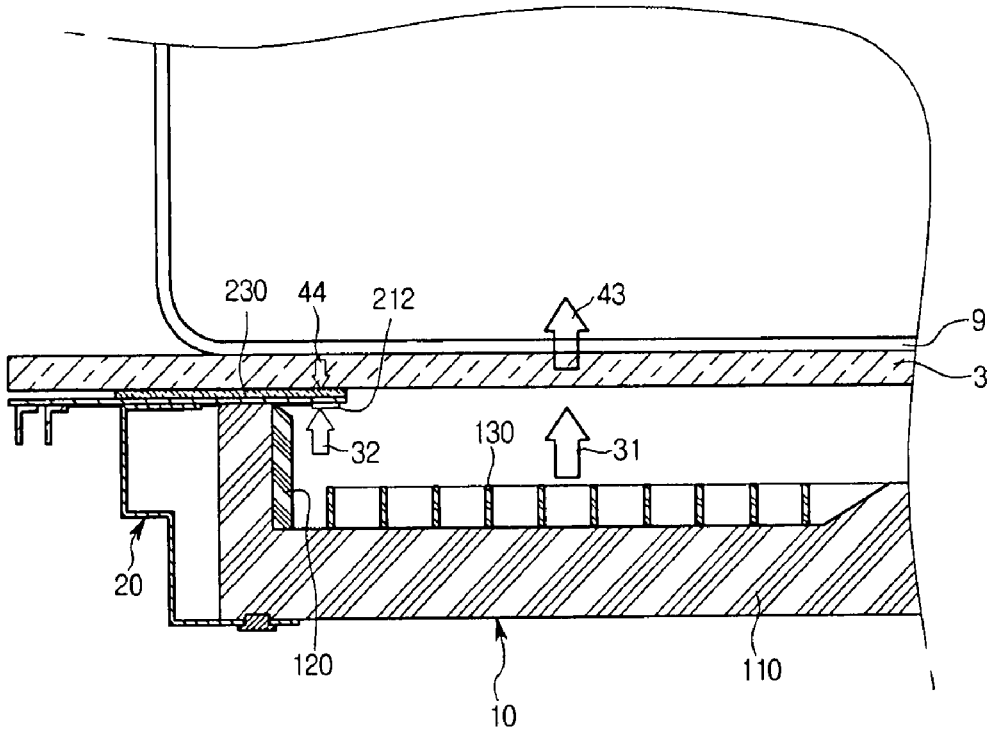
FIG. 10 is a partial sectional view illustrating heat transfers that occur when a cooking container is placed on the heating cooking apparatus.
Figure 11:
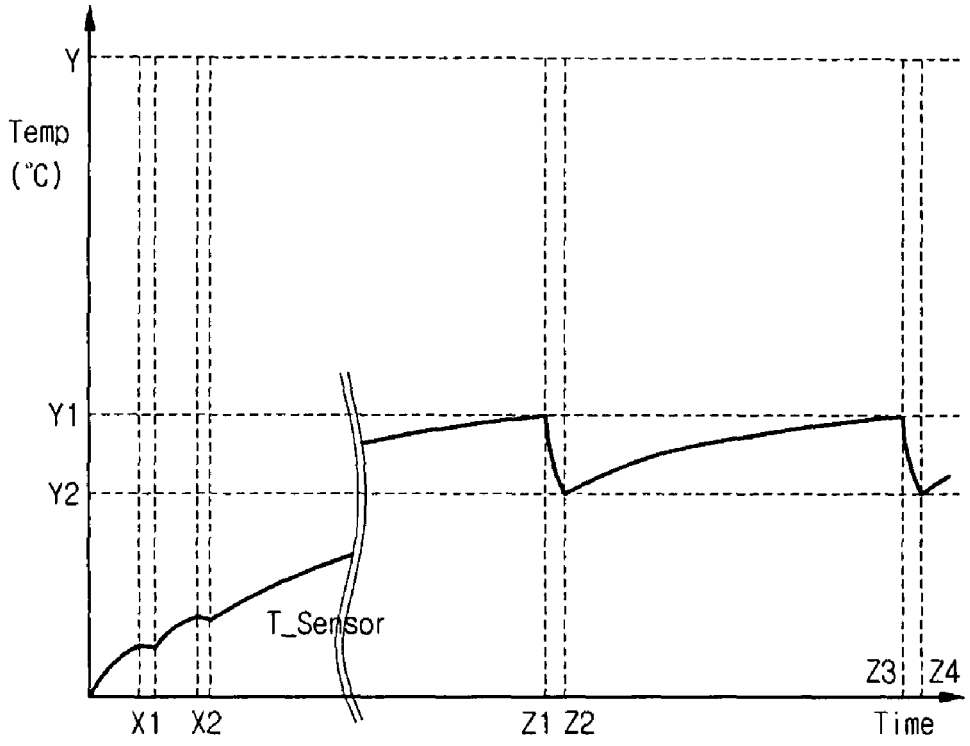
FIG. 11 is a graph illustrating a change of a temperature detected by a detecting member when the cooking container is placed on the heating cooking apparatus.
Figure 12:
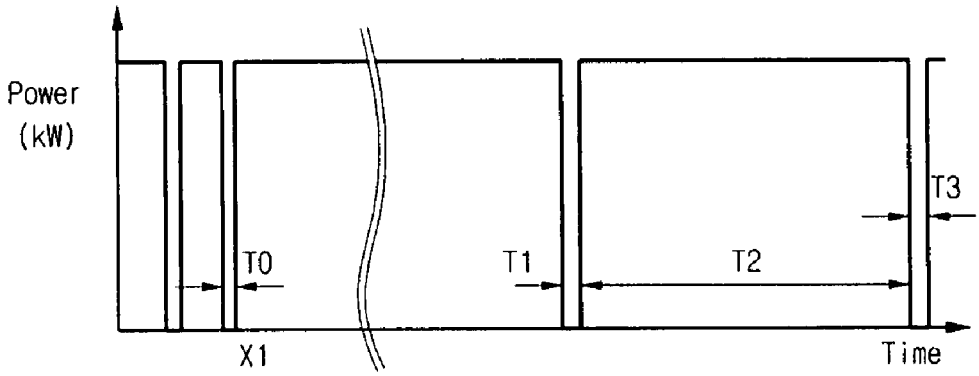
FIG. 12 is a graph illustrating the on/off operations of a heat source when the cooking container is placed on the heating cooking apparatus.

FIG. 10 is a partial sectional view illustrating heat transfers when the cooking container is placed on the heating cooking apparatus; FIG. 11 is a graph illustrating a change of temperature detected by the detecting member when the cooking container is placed on the heating cooking apparatus; and FIG. 12 is a graph illustrating the on/off operations of the heat source when the cooking container is placed on the heating cooking apparatus.

In the case where the load is applied to the ceramic plate 3 will be described below with reference to FIGS. 10 to 12.

When the heat source 130 operates with the cooking container 9 placed on the ceramic plate 3, some heat 31 of heat generated from the heat source 130 is directly transferred to the ceramic plate 3 and some heat 32 is directly transferred to the temperature sensor 212.

On the other hand, a small amount of heat 44 from the heat 31 transferred to the ceramic plate 3 is transferred to the temperature sensor 212, while most of heat 43 is transferred to the cooking container 9.

Since most of the heat transferred to the ceramic plate 3 when the heat source 130 is turned on is transferred to the cooking container 9, the detected temperature slowly increases to reach the first reference temperature Y1, as shown in FIG. 11.

The heat source 130 may be turned on/off at least once as the detected temperature initially reaches the first reference temperature Y1.

When the detected temperature reaches the first reference temperature Y1, the heat source 130 is turned off. When the heat source 130 is turned off, the detected temperature rapidly decreases as shown in FIG. 11.

When the detected temperature reaches the second reference temperature Y2, the heat source 130 is again turned on. The detected temperature slowly increases up to the first reference temperature Y1.

In other words, the heat source 130 is continuously turned on/off such that the temperature detected by the temperature sensor 212 is maintained in a range between the first reference temperature Y1 and the second reference temperature Y2.

When the detected temperature slowly increases, time T2 taken for the detected temperature to reach the first reference temperature Y1 becomes longer, compared with the case where the cooking container 9 is not put on the ceramic plate 3. This means that the on time of the heat source 130 becomes longer, compared with the case where the cooking container 9 is not placed on the ceramic plate 3. That is, the temperature increase rate per unit time is low.

On the other hand, when the detected temperature rapidly decreases, time T1 and T3 taken for the detected temperature to reach the second reference temperature Y2 becomes short. This means that the off time of the heat source 130 becomes shorter, compared with the case where the cooking container 9 is not placed on the ceramic plate 3. That is, the temperature decrease rate per unit time is high.

The duty cycle (i.e., the unit on-time ratio) of the heat source 130 is increased because the on time of the heat source 130 is long and its off time is short.

When the cooking container 9 is placed on the ceramic plate 3, the increase of the duty cycle of the heat source 130 means that heat generated from the heat source 130 is continuously and efficiently transferred to the cooking container 9. Hence, this makes speedy cooking possible.

In this embodiment, the heat source 130 is controlled such that its duty cycle is increased when the cooking container 9 is placed on the ceramic plate 3.

The control unit 8 can determine the presence or absence of the cooking container 9 using the time interval from the first reference temperature Y1 to the second reference temperature Y2 or from the second temperature Y2 to the first reference temperature Y1. In addition, the control unit 8 can determine the presence or absence of the cooking container 9 using the difference of time when the detected temperature initially reaches the first reference temperature Y1.

The change of the detected temperature according to the presence or absence of the cooking container 9 can be obviously compared with reference to FIGS. 8 and 11. The change of the on/off time of the heat source 130 can be obviously compared with reference to FIGS. 9 and 12.

Figure 13:
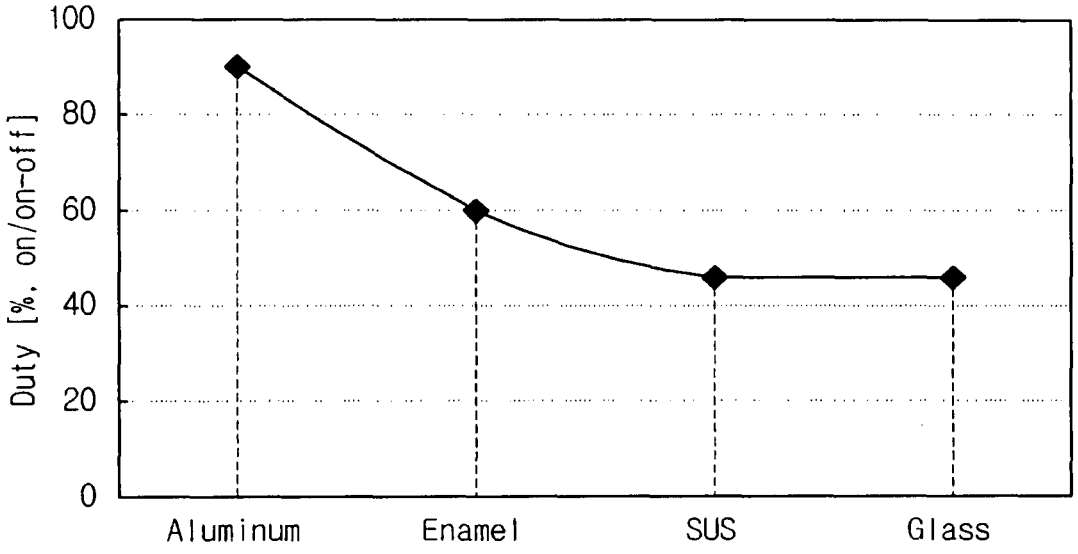
FIG. 13 is a graph illustrating a change of duty cycle according to a kind of a load (a cooking container) that is placed on a ceramic plate.

FIG. 13 is a graph illustrating a change of the duty according to kinds of the load (or the cooking container) put on the ceramic plate.

Referring to FIG. 13, when the heat conductivity of the cooking container 9 placed on the ceramic plate 3 is high, the heat of the ceramic plate 3 can be rapidly transferred to the cooking container 9. On the other hand, when the heat conductivity of the cooking container 9 is low, the heat is not rapidly transferred to the cooking container 9.

For example, in the case where the cooking container 9 is made of aluminum with high heat conductivity, heat of the ceramic plate 3 is rapidly transferred to the cooking container 9. Therefore, time taken for the detected temperature to reach the first reference temperature Y1 becomes longer, while time taken for the detected temperature to reach the second reference temperature Y2 becomes shorter. In this case, the duty cycle may be further increased up to approximately 90%.

On the other hand, in case where the cooking container 9 is made of glass with low heat conductivity, heat of the ceramic plate 3 is slowly transferred to the cooking container 9. Therefore, time taken for the detected temperature to reach the first reference temperature Y1 becomes shorter, while time taken for the detected temperature to reach the second reference temperature Y2 becomes longer. In this case, the duty cycle may be reduced to approximately 45%.

In this embodiment, the duty cycle changes in a range from approximately 0.45 to approximately 0.9 according to kinds of the load.

The actual duty cycle may be close to 0.9 even though the heat conductivity is higher than that of aluminum, and may close to 0.45 even though the heat conductivity is lower than that of glass. Therefore, it is noted that the change of the duty cycle is meaningful in a range from approximately 0.45 to approximately 0.9.

In this embodiment, the temperature is electrically detected by the temperature detecting device 20, and the heat transferred from the ceramic plate 3 is detected. Hence, the high-power heat source can be used and food can be more speedily cooked.

The above described embodiments have advantages over known heating cooking apparatuses. More specifically, in known heating cooking apparatuses, when the heat source has a predetermined power and a load is not applied to the ceramic plate, because the temperature of the heat source is mechanically detected using a thermostat, the duty of the heat source remains the same regardless of the presence or absence of the load.

Further, when the high-power heat source is used for speedy cooking, only the internal temperature condition of the heating unit increases, and thus the thermostat is turned off early so that the duty cycle is reduced. In this case, the heat generated from the high-power heat source is not efficiently transferred to the cooking container.

However, in this embodiment, when the temperature is electrically detected and a load is detected on the ceramic plate, most of heat generated from the high-powered heat source is transferred to the cooking container, and thus the temperature detected from the temperature sensor slowly increases. Hence, the duty cycle of the heat source can be maintained similar the use of the low-power heat source, thereby making speedy cooking possible.

When no load is applied to the ceramic plate, the duty cycle of the heat source is reduced, thereby preventing unnecessary operation of the heat source. Consequently, the power consumption is reduced. On the other hand, when the load is applied to the ceramic plate, the duty cycle of the heat source is increased, thereby making speedy cooking possible.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art and are encompassed by the claims.

What is claimed is:

1. A method for operating a heating cooking apparatus, comprising:

sensing at least one variable using a sensor that is indicative of whether at least one of a load, an absence of load, and a kind of load is present on a plate of the heating cooking apparatus; and controlling a duty cycle of power supplied to a heating source based on the variable sensed by the sensor, wherein a power on portion of duty cycle of power supplied to the heating source when the plate has a load is larger than the power on portion of duty cycle of power supplied to the heater source when the plate has no load, wherein heat of the plate is transferred to the sensor, and the sensor senses the heat from the plate and the heating source, wherein the heating source is turned off at least once prior to the sensed temperature reaching the first reference temperature and then the heating source is turned on until the sensed temperature reaches the first reference temperature.

2. The method of claim 1, wherein sensing at least one variable includes sensing a temperature of the plate or a temperature corresponding to the plate.

3. The method of claim 2, further comprising:

comparing the sensed temperature with a first reference temperature; and switching-off power to the heating source when the sensed temperature reaches the first reference temperature.

4. The method of claim 3, further comprising:

maintaining the switching-off of power to the heating source; and continue sensing the temperature of the plate or the temperature corresponding to the plate.

5. The method of claim 2, further comprising:

comparing the sensed temperature with a second reference temperature; and switching-on power to the heat source when the sensed temperature decreases to the second reference temperature.

6. The method of claim 5, further comprising:

maintaining the switching-on of power to the heating source; and continue sensing the temperature of the plate or the temperature corresponding to the plate.

7. The method of claim 1, wherein the heating source is turned off at least once prior to the sensed temperature reaching a second reference temperature lower than a first reference temperature.

* * * * *